US007888887B2

(12) United States Patent
Utsuno et al.

(10) Patent No.: US 7,888,887 B2
(45) Date of Patent: Feb. 15, 2011

(54) LUMINESCENT LAMP LIGHTING DEVICE

(75) Inventors: Mizuki Utsuno, Niiza (JP); Kazushige Hirata, Niiza (JP); Toru Ashikaga, Niiza (JP); Toyotomo Morita, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 546 days.

(21) Appl. No.: 11/997,025

(22) PCT Filed: Mar. 30, 2006

(86) PCT No.: PCT/JP2006/306657

§ 371 (c)(1),
(2), (4) Date: Jan. 28, 2008

(87) PCT Pub. No.: WO2007/013203

PCT Pub. Date: Feb. 1, 2007

(65) Prior Publication Data

US 2010/0171433 A1 Jul. 8, 2010

(30) Foreign Application Priority Data

Jul. 28, 2005 (JP) ..... 2005-219364

(51) Int. Cl.
*G05F 1/00* (2006.01)

(52) U.S. Cl. ..... 315/307; 315/224; 315/226; 315/159; 315/291; 315/312; 315/209 R

(58) Field of Classification Search ..... 315/209 R, 315/291, 224, 226, 312, 159, 320, 177, 246, 315/276, 307, 121, DIG. 7
See application file for complete search history.

(56) References Cited

U.S. PATENT DOCUMENTS 5,621,281 A * 4/1997 Kawabata et al. ..... 315/311
6,023,131 A * 2/2000 Okita ..... 315/291

(Continued)

FOREIGN PATENT DOCUMENTS

JP 60 9098 1/1985

(Continued)

*Primary Examiner*—Haissa Philogene
(74) *Attorney, Agent, or Firm*—Oblon, Spivak, McClelland, Maier & Neustadt, L.L.P.

(57) ABSTRACT

A luminescent lamp lighting device includes a plurality of switch circuits 3, 4 each connected to each of luminescent lamps 5, 6 in series under one-to-one correspondence, a plurality of optical coupling circuits 9, 10 each connected to each of the switch circuits under one-to-one correspondence to turn on/off the switch circuits and a plurality of current detecting circuits 7, 8 each connected to each of the luminescent lamps in series under one-to-one correspondence to detect currents flowing the luminescent lamps. The device determines whether the luminescent lamps are turned on or not, based on the currents detected by the current detecting circuits and controls the optical coupling circuits based on the determination result so as to allow all of the luminescent lamps but a luminescent lamp requiring a highest lighting voltage to be turned on in order of low lighting voltage, next allow the lighted luminescent lamps to be turned lighted off, and allow all of the remaining luminescent lamps to be turned on again after turning on the luminescent lamp requiring the highest lighting voltage.

2 Claims, 6 Drawing Sheets

U.S. PATENT DOCUMENTS

| | | | | |
|---|---|---|---|---|
| 6,636,190 | B2 * | 10/2003 | Hirakata et al. | 345/74.1 |
| 7,696,698 | B2 * | 4/2010 | Ghanem | 315/123 |
| 7,800,317 | B2 * | 9/2010 | Kimura | 315/307 |
| 2009/0243491 | A1 * | 10/2009 | Iwai | 315/116 |
| 2010/0164385 | A1 * | 7/2010 | Ashikaga et al. | 315/121 |

FOREIGN PATENT DOCUMENTS

| | | |
|---|---|---|
| JP | 6 203983 | 7/1994 |
| JP | 7 249494 | 9/1995 |
| JP | 11 160675 | 6/1999 |
| JP | 2001 235720 | 8/2001 |
| JP | 2002 313593 | 10/2002 |

* cited by examiner

LUMINESCENT LAMP LIGHTING DEVICE

TECHNICAL FIELD

The present invention relates to a luminescent lamp lighting device for lighting a plurality of luminescent lamps, for example, cold cathode fluorescent lamps (CCFL), external electrode fluorescent lamps and fluorescent lamps, by use of a single inverter. More particularly, the invention relates to a luminescent lamp lighting device for lighting a plurality of luminescent lamps connected in parallel.

BACKGROUND OF ART

In the past, the luminescent lamp lighting device used to light a single luminescent lamp by use of a single converter. Meanwhile, in the lighting device for lighting a number of luminescent lamps simultaneously, e.g. luminescent lamps as backlights for a liquid crystal panel, if increasing the number of luminescent lamps, the device would tend to be expensive with the necessity of providing a number of inverters.

For this reason, a luminescent lamp lighting device capable of lighting multiple luminescent lamps by a single inverter has been adopted recently. Nevertheless, the adoption comes a collision with the realities of differences in the lighting-up start voltage (referred to as "lighting voltage") of the luminescent lamps. Due to load resistance characteristics of the luminescent lamps, additionally, the impedance after lighting is remarkably reduced in comparison with that before lighting.

When lighting a plurality of luminescent lamps by use of a single converter using a singe electrical transformer, only connecting of the luminescent lamps with the transformer would cause a luminescent lamp of low lighting voltage to be lighted ahead of the other luminescent lamps. Then, the impedance of the so-lighted luminescent lamp is reduced to cause the secondary voltage of the transformer to be lowered. Consequently, it becomes impossible to light the other luminescent lamps.

In this view, there has been adopted a method of individually lighting a plurality of luminescent lamps by an inverter using a plurality of electrical transformers. FIG. 1 shows the constitution of a conventional luminescent lamp lighting device for lighting two luminescent lamps by an inverter using two transformers. In FIG. 1, the shown luminescent lamp lighting device includes a direct-current power source 1, an inverter 2 using two transformers 24 and 26, a luminescent lamp 5 connected to the secondary side of the transformer 24 and a luminescent lamp 6 connected to the secondary side of the transformer 26.

The inverter 2 includes a switching element 21, a switching element 22 and a control circuit 23. The switching elements 21 and 22 are connected to the direct-current power source 1 in series. Respective gates of the switching elements 21 and 22 are connected to the control circuit 23. Connected in parallel to the switching element 22 are a parallel circuit having a primary winding of the transformer 24 and a primary winding of the transformer 25, and a condenser 25 also connected to the parallel circuit in series.

An end of the secondary winding of the transformer 24 is connected to an end of the luminescent lamp 5, while the other end of the winding is connected to the ground. An end of the secondary winding of the transformer 26 is connected to an end of the luminescent lamp 6, while the other end of the winding is connected to the ground. Respective other ends of the luminescent lamps 5 and 6 are connected to the ground.

The switching elements 21 and 22 are under the alternating ON/OFF control of the control circuit 23 to apply voltage of the direct-current power source 1 to the primary winding of the transformer 24, the primary winding of the transformer 26 and the condenser 25 intermittently. The voltage applied to the primary windings of the transformers 24 and 26 is respectively elevated by the transformers 24 and 26, so that high-frequency voltage occurs in the secondary winding of the transformer 24 and the secondary winding of the transformer 26. The high-frequency voltage occurring in the secondary winding of the transformer 24 is applied to the luminescent lamp 5, while the high-frequency voltage occurring in the secondary winding of the transformer 26 is applied to the luminescent lamp 6. Therefore, the conventional luminescent lamp lighting device of FIG. 1 is provided to light two luminescent lamps 5 and 6 by driving them with two transformers individually.

As another conventional luminescent lamp lighting device, there is well-known a device that a ballast element is connected to an output stage of an inverter using a single transformer so as to apply high-frequency voltage to a plurality of fluorescent lamps through the ballast element.

FIG. 2 shows the constitution of the other conventional luminescent lamp lighting device for lighting two luminescent lamps with the above structure where the ballast element is connected to the output stage of the inverter. In FIG. 2, the shown luminescent lamp lighting device has condensers C1 and C2 (as the ballast element) connected to the secondary winding of the transformer 24 to apply high-frequency voltage to the luminescent lamps 5 and 6 through the condensers C1 and C2.

In such a structure where the ballast element is connected to the secondary winding of the transformer 24, as the impedance of the ballast element is higher that the impedance of luminescent lamp, the impedance in the sight from the secondary winding would not vary so much even if the impedance of the luminescent lamp is lowered as a result of its lighting up. Thus, there is no reduction in the voltage occurred in the secondary winding of the transformer 24, allowing the other luminescent lamp to be lighted. Again, since the impedance of the ballast element is higher that the impedance of luminescent lamp, the difference of the composite impedance of the luminescent lamps and the ballast element gets smaller in spite of a difference between respective impedances of the luminescent lamps, allowing the luminescent lamps to be equalized in their luminance.

Additionally, Japanese Unexamined Patent Publication (heisei) No. 7-249494 discloses a luminescent lamp lighting device for lighting a plurality of luminescent lamps with a single transformer, in which a ballast element, the luminescent lamps and a two-way switch are connected in series on the secondary side of the transformer. This luminescent lamp lighting device is equivalent to the conventional luminescent lamp lighting device of FIG. 2 provided that the luminescent lamps and the ballast element are connected to a two-way switch in series, allowing the luminescent lamps to be lighted on and off under the ON/OFF control of the two-way switch.

DISCLOSURE OF THE INVENTION

However, the conventional luminescent lamp lighting device of FIG. 1 is expensive with the use of two transformers and also large-sized with the requirement of a space for installing these transformers in the device.

The conventional luminescent lamp lighting device of FIG. 2 requires a ballast element for lighting all of luminescent lamps certainly. When the ballast element is connected to the luminescent lamps in series, the voltage applied to the luminescent lamps is reduced due to voltage-dividing with the ballast element. Thus, it is necessary to raise the secondary-side voltage of the transformer by just that reduction in voltage.

Further, the luminescent lamp lighting device of the above citation has the two-way switch in electrical connection. In order to effect the electrical connection about the two-way switch, it is necessary to connect the two-way switch to the low-voltage side of the luminescent lamps. Despite that the two-way switch is connected to the low-voltage side of the luminescent lamps, however, if desired to light luminescent lamps requiring high voltage and high frequency, such as cold cathode fluorescent lamps, there is caused a phenomenon that even if turning off the two-way switch, current would flow into the ground by only circuit capacity of the two-way switch, so that the luminescent lamps could not be lighted off by the two-way switch only.

For this reason, the luminescent lamp lighting device of the above citation also requires condensers as the ballast element, which is similar to the conventional luminescent lamp lighting device of FIG. 2. Additionally, as the luminescent lamp lighting device of the above citation is similar to the conventional luminescent lamp lighting devices of FIGS. 1 and 2 in terms of its lighting method, it is impossible to light a plurality of luminescent lamps certainly.

An object of the present invention is to provide a luminescent lamp lighting device that enables a plurality of luminescent lamps to be lighted certainly, while there is no need of providing a plurality of transformers and a ballast element connected to the luminescent lamps in series.

In order to solve the problems, according to the main aspect of the present invention, there is provided a luminescent lamp lighting device comprising: an inverter converting direct-current voltage to high-frequency voltage; a plurality of luminescent lamps to which the high-frequency voltage generated from the inverter is applied, the luminescent lamps being connected in parallel to each other; a plurality of switch circuits each connected to each of the luminescent lamps in series under one-to-one correspondence; a plurality of optical coupling circuits each connected to each of the switch circuits under one-to-one correspondence to turn on/off the switch circuits; a plurality of current detecting circuits each connected to each of the luminescent lamps in series under one-to-one correspondence to detect respective currents flowing the luminescent lamps; and a control circuit configured to determine whether the plurality of luminescent lamps are lighting or not, based on the currents detected by the plurality of current detecting circuits and control the optical coupling circuits based on the determination result so as to: allow all of the luminescent lamps but a luminescent lamp requiring a highest lighting voltage to be turned on in order of low lighting voltage; next allow the lighted luminescent lamps to be turned off; and allow all of the remaining luminescent lamps to be turned on again after turning on the luminescent lamp requiring the highest lighting voltage.

BEST MODE FOR CARRYING OUT THE INVENTION

Figure 1:
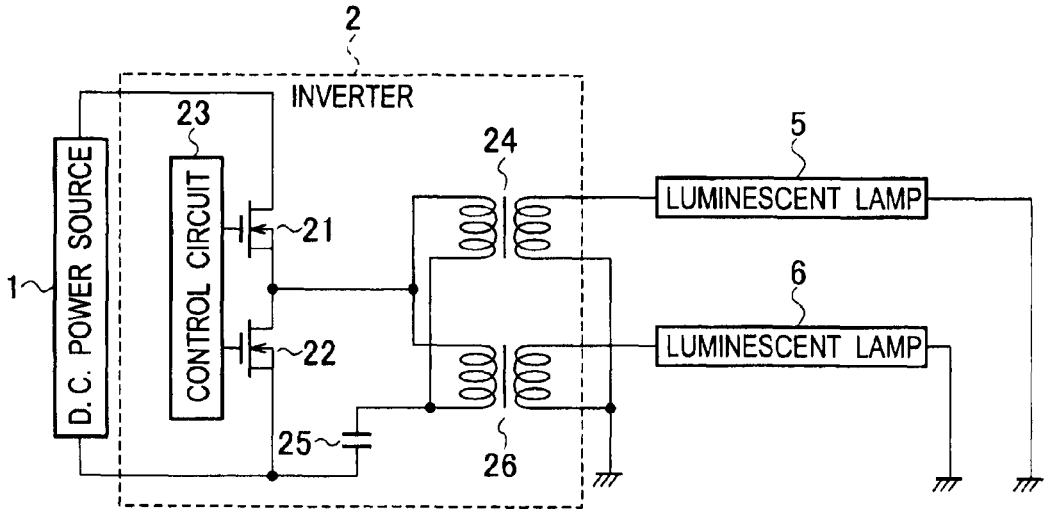
FIG. 1 PRIOR ART
FIG. 1 is a block diagram showing a conventional luminescent lamp lighting device.
Figure 2:
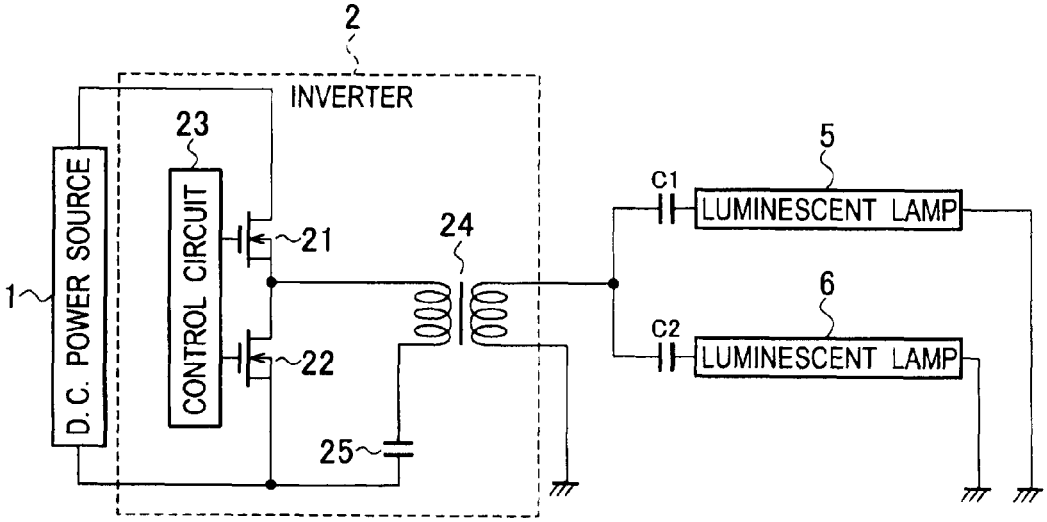
FIG. 2 PRIOR ART
FIG. 2 is a block diagram showing another conventional luminescent lamp lighting device.

Referring to drawings, a luminescent lamp lighting device in an embodiment of the present invention will be described below in detail. While the present invention will be described below by citing the example of two fluorescent lamps, the number of fluorescent lamps is not limited to this and may be selected by a given value. Additionally, elements identical or relevant to the constituents of the fluorescent lamp lighting devices explained in the column "BACKGROUND OF ART" are indicated with the same reference numerals, respectively.

EMBODIMENT

Figure 3:
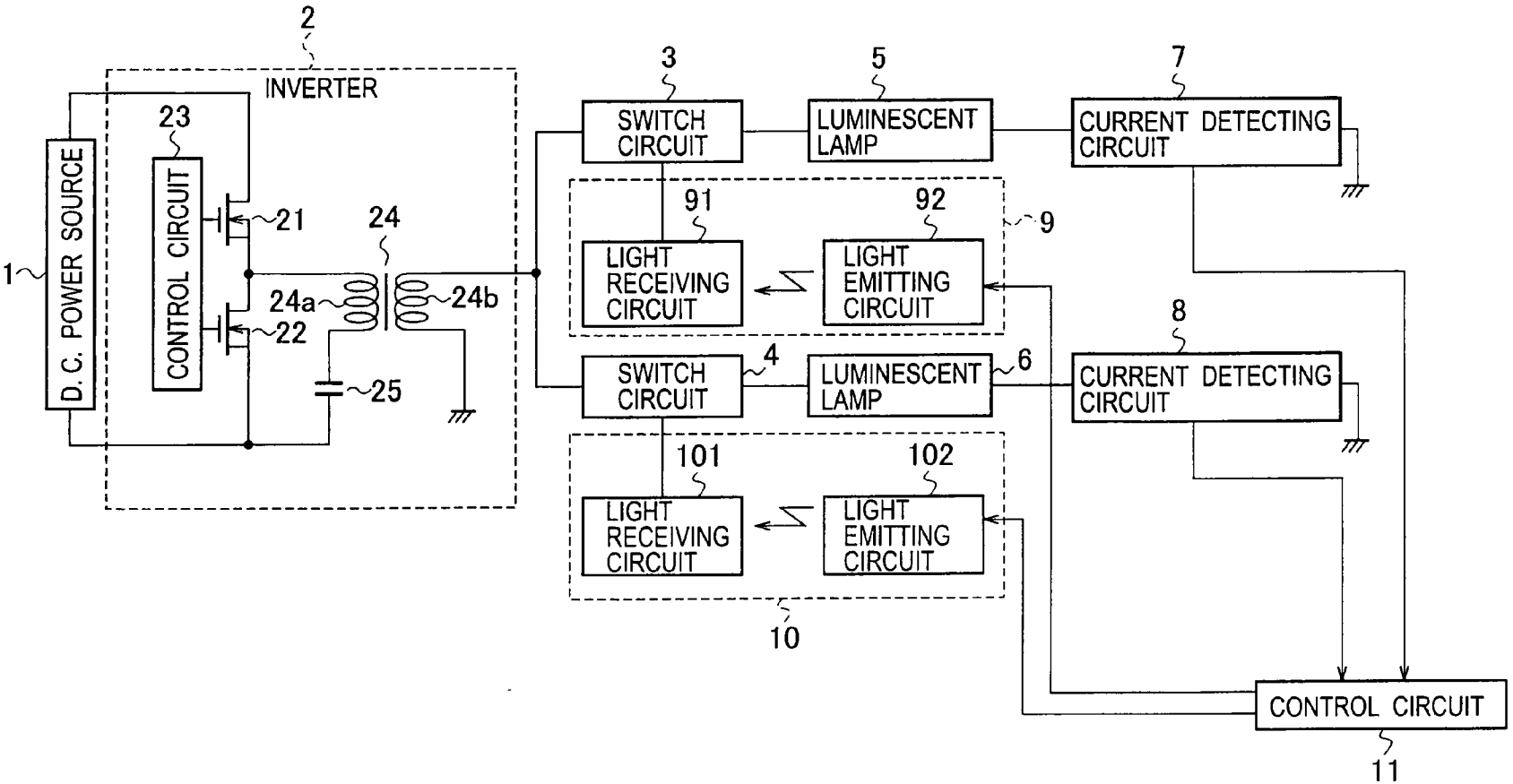
FIG. 3 is a block diagram showing the constitution of a luminescent lamp lighting device in accordance with a first embodiment of the present invention.

FIG. 3 is a view showing the constitution of a luminescent lamp lighting device in accordance with the first embodiment of the present invention. The luminescent lamp lighting device of this embodiment comprises a direct-current power source 1, an inverter 2, switch circuits 3 and 4, luminescent lamps 5 and 6, current detecting circuits 7 and 8, optical coupling circuits 9 and 10 and a control circuit 11. The optical coupling circuit 9 comprises a light receiving circuit 91 and a light emitting circuit 92, while the optical coupling circuit 10 comprises a light receiving circuit 101 and a light emitting circuit 102. The luminescent lamps 5 and 6 comprise, for example, cold cathode fluorescent lamps, external electrode fluorescent lamps, fluorescent lamps and so on.

The inverter 2 includes a switching element 21, a switching element 22, a control circuit 23, a transformer 24 and a condenser 25. The switching elements 21 and 22 are connected to the direct-current power source 1 in series. Respective gates of the switching elements 21, 22 are connected to the control circuit 23. A primary winding 24*a* of the transformer 24 and a condenser 25 connected to the primary winding 24*a* are together connected to the switching element 22 in parallel.

In the transformer 24, one end of its secondary winding 24*b* is connected to respective ends of the switch circuits 3 and 4, while the other end of the winding 24*b* is connected to the ground. The other end of the switch circuit 3 is connected to one end of the luminescent lamp 5, while the other end of the switch circuit 4 is connected to one end of the luminescent lamp 6. The other end of the luminescent lamp 5 is connected to one end of the current detecting circuit 7, while the other end of the luminescent lamp 6 is connected to one end of the current detecting circuit 8. The other ends of the current detecting circuits 7 and 8 are connected to the ground. The control circuit 11 is connected to the light emitting circuits 92 and 102. Further, the switch circuit 3 is connected to the light receiving circuit 91, while the switch circuit 4 is connected to the light receiving circuit 101.

That is, the switch circuits 3 and 4 are connected to the luminescent lamps 5 and 6 on the high-voltage sides in series and turned on/off by signals from the optical coupling circuits 9 and 10, respectively.

The optical coupling circuit 9 includes the light receiving circuit 91 and the light emitting circuit 92. When receiving light emitted from the light emitting circuit 92, the light receiving circuit 91 outputs the switch circuit 3 the signal for turning on it. The optical coupling circuit 10 includes the light receiving circuit 101 and the light emitting circuit 102. When receiving light emitted from the light emitting circuit 102, the light receiving circuit 101 outputs the switch circuit 4 the signal for turning on it.

As the switch circuits 3 and 4 are turned on/off by the signals from the optical coupling circuits 9 and 10 respectively, the switch circuits 3 and 4 are floating above the ground. For this reason, the switch circuits 3 and 4 can be arranged on the high-voltage sides of the luminescent lamps 5 and 6, respectively. Even if lighting luminescent lamps requiring high-voltage and high-frequency voltage, such as cold cathode fluorescent lamps, the luminescent lamps 5 and 6 can be turned off by the switch circuits 3 and 4.

Figure 4:
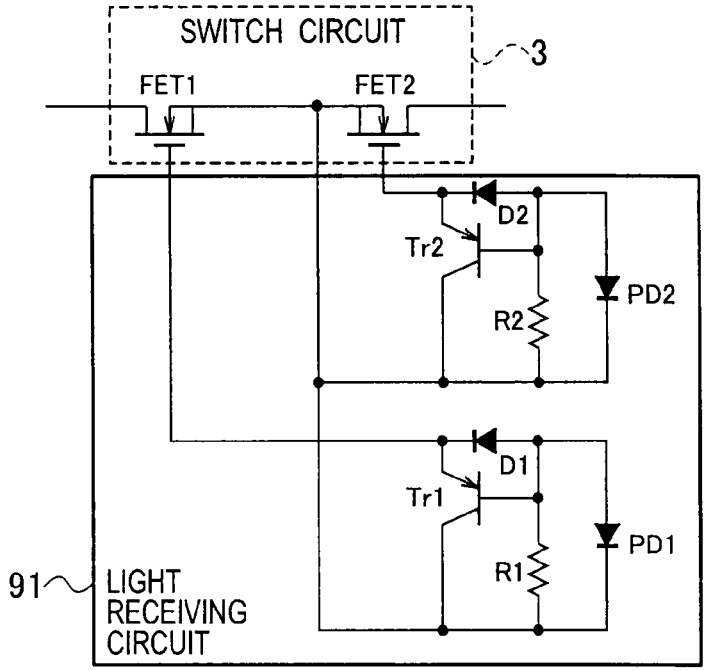
FIG. 4 is a circuit diagram showing one example of a switch circuit and a light receiving circuit.

FIG. 4 is a circuit diagram showing one example of the switch circuit 3 and the light receiving circuit 91. As shown in FIG. 4, the switch circuit 3 is formed by FET1 and FET2, for instance. The light receiving circuit 91 comprises, for instance, transistors Tr1 and Tr2, diodes D1 and D2, photodiodes PD1 and PD2 and resistances R1 and R2. For example, n-channel MOSFET is provided for FET1 and FET2 each, while bipolar transistor is provided for the transistor Tr1, Tr2 each.

A drain of FET1 is connected to an end of the secondary winding 24*b* of the transformer 24. A source of FET1 is connected to a source of FET2. A drain of FET2 is connected to an end of the luminescent lamp 5. A gate of FET1 is connected to an emitter of the transistor Tr1 and a cathode of the diode D1. A collector of the transistor Tr1 is connected to a connection point between a source of FET1 and a source of FET2. An anode of the diode D1 is connected to a base of the transistor Tr1 and an anode of the photodiode PD1. A cathode of the photodiode PD1 is connected to a collector of the transistor Tr1. The resistance R1 has one end connected to the base of the transistor Tr1 and the other end connected to the collector of the Tr1.

A gate of FET2 is connected to an emitter of the transistor Tr2 and a cathode of the diode D2. A collector of the transistor Tr2 is connected to the connection point between the source of FET1 and the source of FET2. An anode of the diode D2 is connected to a base of the transistor Tr2 and an anode of the photodiode PD2. A cathode of the photodiode PD2 is connected to a collector of the transistor Tr2. The resistance R2 has one end connected to the base of the transistor Tr2 and the other end connected to the collector of the Tr2.

In the switch circuit 3, when the photodiodes PD1 and PD2 receive light from the light emitting circuit 92, an electromotive force of the photodiode PD1 is charged to the gate of FET1 through the diode D1 to effect a conduction of FET1 in between the drain and the source and simultaneously, an electromotive force of the photodiode PD2 is charged to the gate of FET2 through the diode D2 to effect a conduction of FET2 in between the drain and the source. In the switch circuit 3, when no light is emitted from the light emitting circuit 92, electric charge accumulated in the gate of FET1 causes the flowing of an electric current through the emitter and the base of the transistor Tr1 and the resistance R1, so that the transistor Tr1 is turned on, while FET1 is turned off by the discharging of electric charge in the gate. Simultaneously, electric charge accumulated in the gate of FET2 causes the flowing of an electric current through the emitter and the base of the transistor Tr2 and the resistance R2, so that the transistor Tr2 is turned on, while FET2 is turned off by the discharging of electric charge in the gate.

Note that the switch circuit 4 and the light receiving circuit 101 are similar in constitution to the switch circuit 3 and the light receiving circuit 91, respectively.

The light emitting circuits 92 and 102 are equipped with light emitting elements that emit light on receipt of signals from the control circuit 11. For example, infrared-emitting diodes etc. are provided for the light emitting diodes.

The current detecting circuit 7 detects a current flowing in the luminescent lamp 5 and outputs a signal corresponding to the detected current to the control circuit 11. The current detecting circuit 8 detects a current flowing in the luminescent lamp 6 and outputs a signal corresponding to the detected current to the control circuit 11.

Based on the currents detected by the current detecting circuits 7 and 8, the control circuit 11 judges whether the luminescent lamps 5 and 6 are now lighting up or not and further controls the optical coupling circuits 9 and 10 on the basis of the above judgments, respectively. In detail, based on the signals from the current detecting circuits 7 and 8, the control circuit 11 allows the light emitting elements of the light emitting circuits 92 and 102 to emit lights, while the light receiving circuits 91 and 101 receive the lights from the light emitting elements thereby to turn on/off the switch circuits 3 and 4, respectively.

The control circuit 11 operates in a lighting mode in order to allow the luminescent lamp lighting device to light the luminescent lamps 5 and 6 at starting certainly and in a current regulating mode to regulate the currents flowing in the luminescent lamps 5 and 6 in view of equalizing their luminance after lighting. The details of the lighting mode and the current regulating mode will be described later.

The operation of the luminescent lamp lighting device of the embodiment will be described in detail, with reference to FIG. 3. First, when the luminescent lamp lighting device is turned on power, the voltage of the direct-current power source 1 is applied to the switching elements 21 and 22, while the control circuit 11 controls the optical coupling circuits 9 and 10 to turn on the switch circuits 3 and 4. The control circuit 23 controls to alternately turn on/off the switching elements 21 and 22 connected to the direct-current power source 1 in series so that the voltage of the direct-current power source 1 is applied to the primary winding 24*a* of the transformer 24 and the condenser 25 intermittently. The intermittent application of the direct-current voltage to the primary winding 24*a* and the condenser 25 causes a resonance due to both inductance of the primary winding 24*a* and capacitance of the condenser 25.

Sinusoidal high-frequency voltage originating in the resonance current is elevated by the transformer 24, generating a high-voltage and high-frequency voltage in the secondary winding 24*b* of the transformer 24. The high-frequency voltage occurring in the secondary winding 24*b* of the transformer 24 is applied to the luminescent lamp 5 through the switch circuit 3 and also the luminescent lamp 6 through the switch circuit 4. Then, the lighting mode of the control circuit 11 is activated to light the luminescent lamps 5 and 6.

The operation in the lighting mode to light the luminescent lamps 5 and 6 certainly will be described with the time chart of FIG. 6. In the following description, it is assumed that the lighting voltage for the luminescent lamp 5 is lower than that lighting voltage for the luminescent lamp 6.

The lighting mode is a mode in order to certainly light a plurality of luminescent lamps by making use of a specific nature that although a luminescent lamp such as cold cathode fluorescent lamp requires a high light voltage at the start of lighting, the re-lighting of the lamp could be dispensed with such a high lighting voltage once it is lighted on and subsequently lighted off.

Figure 5:
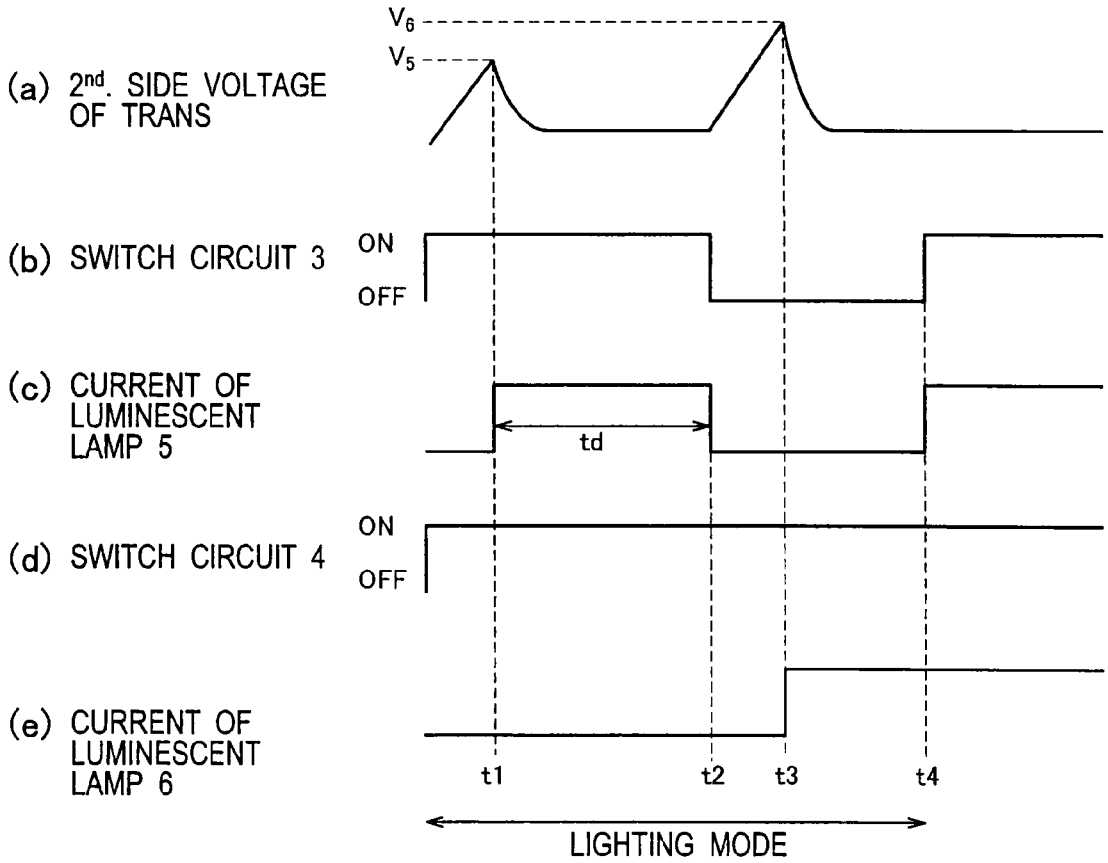
FIG. 5 is a time chart showing the operation of the luminescent lamp lighting device in the first embodiment of the present invention.

In the inverter 2, as shown in FIG. 5, the secondary-side voltage of the transformer 24 rises gradually. When the secondary-side voltage of the transformer 24 rises up to a lighting voltage $V_5$ of the luminescent lamp 5 (at time t1), it is lighted up, so that current flows in the lamp 5. The current detecting circuit 7 detects the current and outputs a signal corresponding to the so-detected current to the control circuit 11. The lighting of the luminescent lamp 5 causes the secondary-side voltage of the transformer 24 to fall down.

Based on the signal from the current detecting circuit 7, the control circuit 11 detects that the luminescent lamp 5 has been turned on. After lighting the luminescent lamp 5 for a predetermined period td from time t1, the control circuit 11 controls the optical coupling circuit 9 to turn off the switch circuit 3 (time t2). By turning off the switch circuit 3, the luminescent lamp 5 is turned off, so that no current flows in the lamp 5. Consequently, the current detecting circuit 7 stops outputting the signal to the control circuit 11, so that it detects that the luminescent lamp 5 has been turned off. The secondary-side voltage of the transformer 24 rises again since the switch circuit 3 is turned off.

When the secondary-side voltage of the transformer 24 rises up to a lighting voltage $V_6$ (at time t3) of the luminescent lamp 6, it is lighted up, so that current flows in the lamp 6. The current detecting circuit 8 detects the current and outputs a signal corresponding to the so-detected current to the control circuit 11. The lighting of the luminescent lamp 6 causes the secondary-side voltage of the transformer 24 to fall down.

Based on the signal from the current detecting circuit 8, the control circuit 11 detects that the luminescent lamp 6 has been turned on. After lighting the luminescent lamp 6, the control circuit 11 controls the optical coupling circuit 10 to turn off the switch circuit 3 (time t4). Then, although the secondary-side voltage of the transformer 24 does not reach the lighting voltage $V_5$ of the luminescent lamp 5, it can be lighted with a smaller voltage since the lamp 5 was lighted once.

Thus, in the lighting mode, the control circuit 11 operates to turn on the luminescent lamp 5 requiring a low lighting voltage initially and turn off the luminescent lamp 5 after the lapse of a predetermined period. After turning on the luminescent lamp 6 having a high lighting voltage, the control circuit 11 turns on the luminescent lamp 5 again. When the luminescent lamps 5 and 6 are together lighted up, the operation of the control circuit 11 is switched to the current regulating mode.

In case of three or more luminescent lamps, the optical coupling circuits are controlled so that all but a luminescent lamp requiring the highest lighting voltage are sequentially lighted in order of low lighting voltage, and the so-lighted luminescent lamps are turned off and finally, the remaining luminescent lamps are again turned on after completing to turn on the luminescent lamp requiring the highest lighting voltage.

For instance, in case of three luminescent lamps, a luminescent lamp A requiring the lowest lighting voltage is turned on for a predetermined period and then, the light A is turned off. Next, a luminescent lamp B requiring next lowest lighting voltage to the lamp A is turned on for a predetermined period and then, the light B is turned off. Next, a luminescent lamp C requiring the highest lighting voltage is turned on. After lighting up the luminescent lamp C, the luminescent lamps A and B are together turned on again.

Note that if an interval from turning off a lighted luminescent lamp up to turning on the same luminescent lamp again (i.e. interval from time t3 up to time t4) is too long, there is a possibility that a certain luminescent lamps cannot be lighted up in lighting again due to recovering of the lighting voltage. In this view, it is necessary to make the interval from turning-off up to turning-on less than several hundred milliseconds.

Next, the operation in the current regulating mode will be described below. In the current regulating mode, respective ON/OFF cycles of the switch circuits 3 and 4 are controlled so that respective average values of the currents detected by the current detecting circuits 7 and 8 after lighting the luminescent lamps 5 and 6 are equal to a predetermined value.

Based on currents (current values) detected by the current detecting circuits 7 and 8, if the current flowing in the luminescent lamp 5 is not equal to the current flowing in the luminescent lamp 5, the switch circuits 3 and 4 are switched to either ON-state or OFF-state by controlling the operations of the optical coupling circuits 9 and 10, thereby equalizing the an average of the current flowing in the luminescent lamp 5 and an average of the current flowing in the luminescent lamp 6 by controlling switching cycles (duty ratios) in switching ON/OFF-state.

According to the current regulating mode, if the current flowing in the luminescent lamp 5 is larger than the current flowing in the luminescent lamp 6 after they are lighted up, an ON cycle in the switch circuit 3 connected to the luminescent lamp 5 is reduced. The reduction in the ON cycle in the switch circuit 3 allows an average current (value) flowing in the luminescent lamp 5 to be reduced. Thus, in the current regulating mode, the average values of currents flowing in the luminescent lamps 5 and 6 are controlled by adjusting the ON/OFF cycles of the switch circuits 3 and 4.

Figure 6:
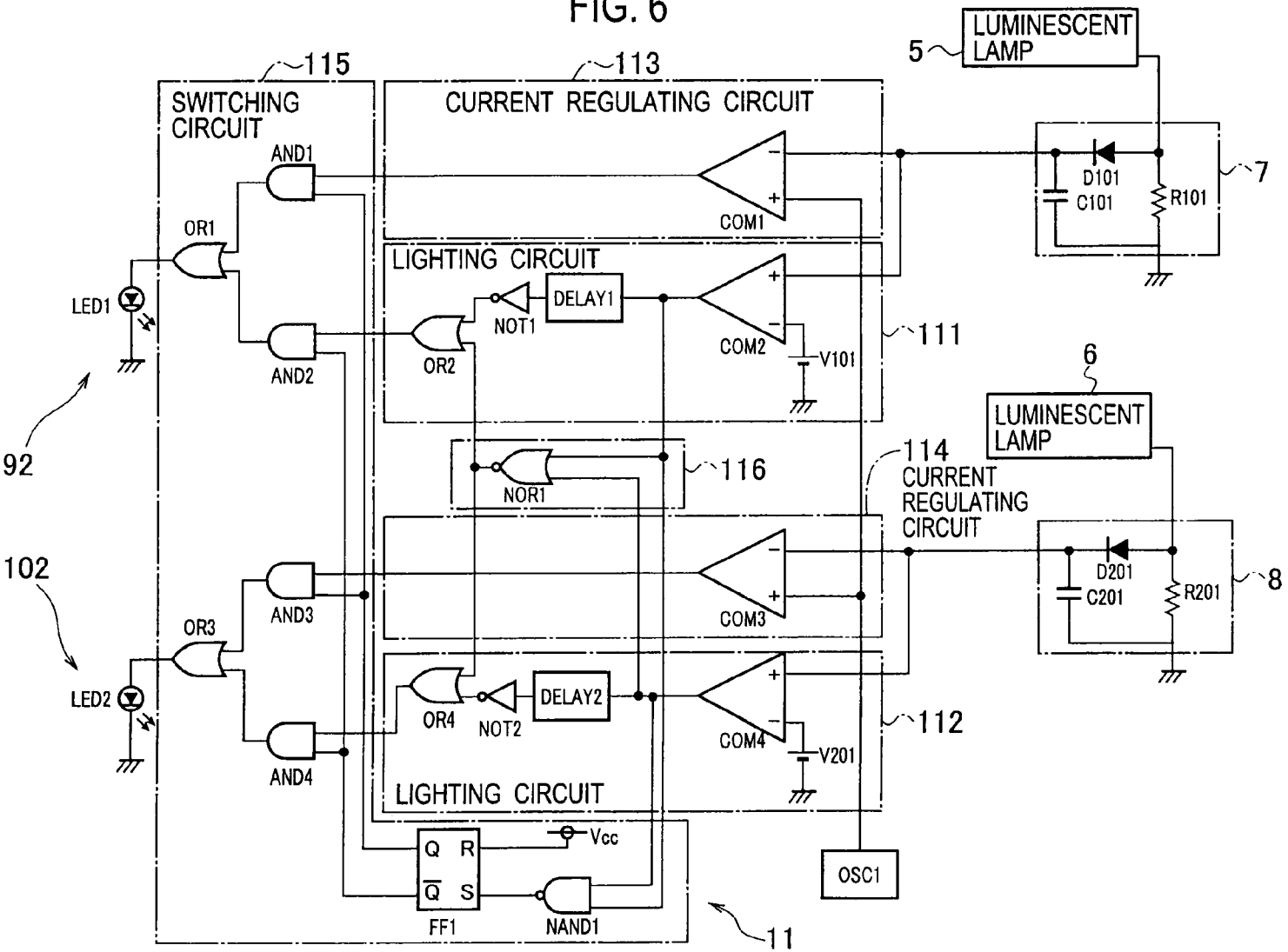
FIG. 6 is a circuit diagram showing one example of a current detecting circuit and a control circuit.

FIG. 6 is a circuit diagram showing an example of the current detecting circuit 7, the current detecting circuit 8 and the control circuit 11. As shown in FIG. 6, the current detecting circuit 7 includes a resistance R101, a diode D101 and a condenser C101, while the current detecting circuit 8 includes a resistance R201, a diode D201 and a condenser C201. The resistance R101 has one end connected to the luminescent lamp 5 and an anode of the diode D101 and the other end connected to the ground and one end of the condenser C101. A cathode of the diode D101 is connected to the other end of the condenser C101 and the control circuit 11.

Similarly, the resistance R201 has one end connected to the luminescent lamp 6 and an anode of the diode D201 and the other end connected to the ground and one end of the condenser C201. A cathode of the diode D201 is connected to the other end of the condenser C201 and the control circuit 11.

The control circuit 11 comprises a lighting circuit 111 for turning on the luminescent lamp 5 in the lighting mode, a lighting circuit 112 for turning on the luminescent lamp 6 in the lighting mode, a current regulating circuit 113 for regulating the current flowing in the luminescent lamp 6 in the current regulating mode, a current regulating circuit 114 for regulating the current flowing in the luminescent lamp 6 in the current regulating mode, a switching circuit 115 for switching the lighting mode to the current regulating mode and vice versa and an initializing circuit 116 for initializing the switch circuit 3 and the switch circuit 4 when the luminescent lamp lighting device is powered on.

The lighting circuit 111 comprises a comparator COM2, a direct-current power source V101, a delay circuit DELAY1, a NOT circuit NOT1 and an adder circuit OR2. Similarly, the lighting circuit 112 comprises a comparator COM4, a direct-current power source V201, a delay circuit DELAY2, a NOT circuit NOT2 and an adder circuit OR4.

The current regulating circuit 113 comprises a comparator COM1 and an oscillator OSC1, while the current regulating circuit 114 comprises a comparator COM3 and the oscillator OSC1 as well.

The switching circuit 115 comprises a RS flip-flop FF1, multiplier circuits AND1, AND2, AND3, AND4, adder circuits OR1, OR3 and an inverted AND circuit NAND1. The initializing circuit 116 is formed by an inverted OR circuit NOR1.

In the current detecting circuit 7, the diode D101 has its cathode connected to an inversion terminal of COM1 and a non-inversion terminal of COM2. The diode D201 has its cathode connected to an inversion terminal of COM3 and a non-inversion terminal of COM4. Respective non-inversion terminals of COM1 and COM3 are connected to OSC1.

An inversion terminal of COM2 is connected to the positive side of V101, while the negative side of V101 is connected to the ground. An inversion terminal of COM4 is connected to the positive side of V201, while the negative side of V201 is connected to the ground. An output terminal of COM1 is connected to an input terminal of AND1, while an output terminal of COM3 is connected to an input terminal of AND3.

An output terminal of COM2 is connected to an input terminal of DELAY1, an input terminal of NOR1 and an input terminal of NAND1. An output terminal of COM4 is connected to an input terminal of DELAY2, the input terminal of NOR1 and the input terminal of NAND1. An output terminal of DELAY1 is connected to an input terminal of NOT1, while an output terminal of NOT1 is connected to an input terminal of OR2. An output terminal of DELAY2 is connected to an input terminal of NOT2, while an output terminal of NOT2 is connected to an input terminal of OR4. An output terminal of NOR1 is connected to an input terminal of OR2 and an input terminal of OR4.

An output terminal of OR2 is connected to an input terminal of AND2. An output terminal OR4 of is connected to an input terminal of AND4. An output terminal of NAND1 is connected to a set terminal of FF1, while a reset terminal of FF1 is connected to a power source VCC. An output terminal Q of FF1 is connected to an input terminal of AND1 and an input terminal of AND3, while an inversion terminal of the output terminal Q is connected to an input terminal of AND2 and an input terminal of AND4.

Respective output terminals of AND1 and AND2 are connected to input terminals of OR1, while respective output terminals of AND3 and AND4 are connected to input terminals of OR3. An output terminal of OR1 is connected to an anode of a light emitting diode LED1, while a cathode of LED1 is connected to the ground. An output terminal of OR3 is connected to an anode of a light emitting diode LED2, while a cathode of LED2 is connected to the ground.

Figure 7:
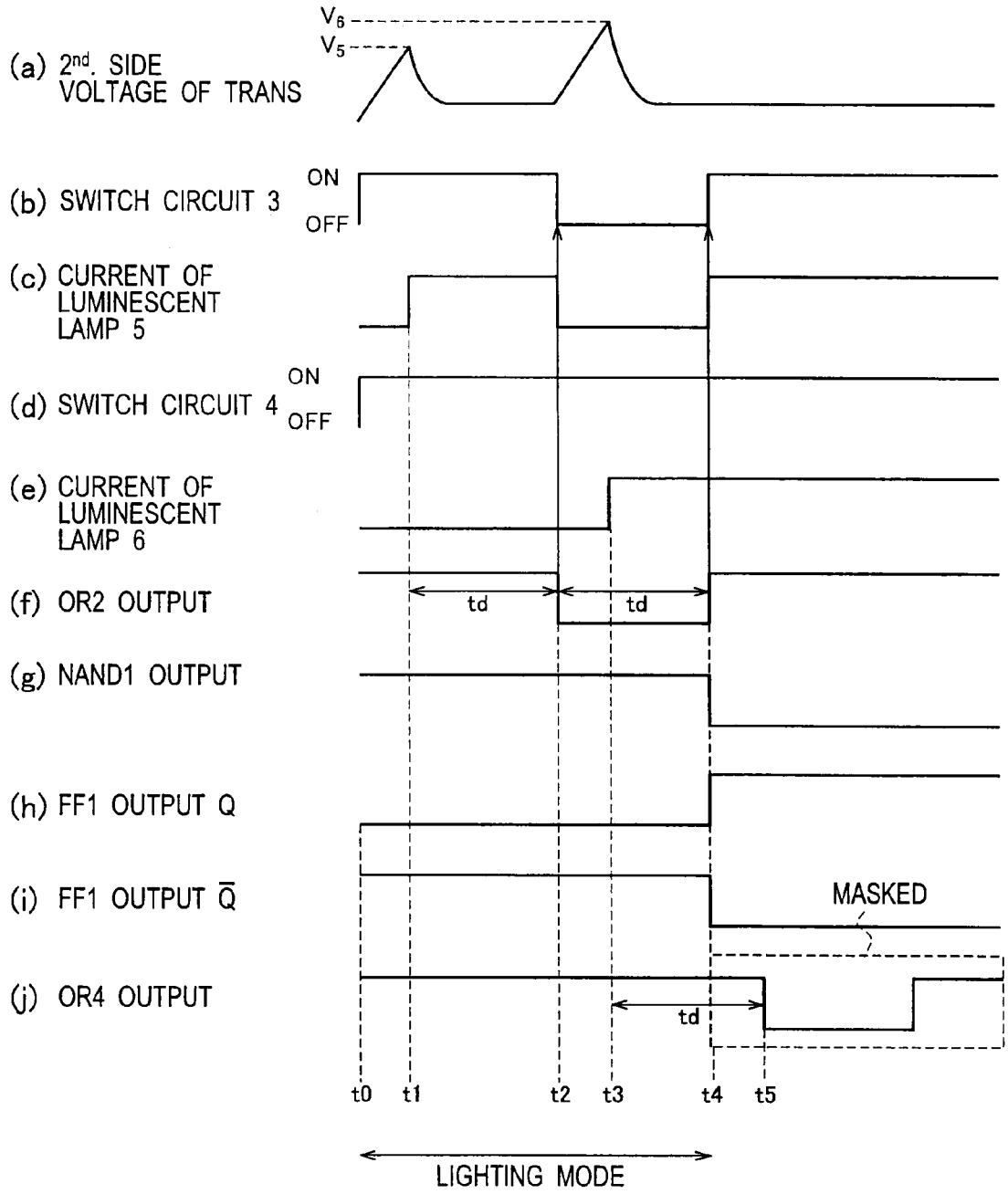
FIG. 7 is a time chart showing the operation of the control circuit of FIG. 6 in its lighting mode.

Next, the operation of the so-constructed control circuit 11 of FIG. 6 will be described. FIG. 7 is a time chart showing the operation of the control circuit of FIG. 6 in the lighting mode. As shown in FIG. 7, when the luminescent lamp lighting device is powered on, the power source VCC is inputted to the reset terminal of FF1. Consequently, FF1 is powered on for its reset, so that a L-level signal is outputted from the output terminal Q to AND1 and AND3, while a H-level signal is outputted from the inversion terminal of the output terminal Q to AND2 and AND4 (at time t0). Thus, respective outputs of AND1 and AND3 are fixed to L-level, and respective outputs of the current regulating circuits 113 and 114 are masked to allow AND2 and AND4 to transmit outputs of the lighting circuits 111 and 112, respectively. That is, the control circuit 11 is brought into the lighting mode.

At this time, as outputs of COM2 and COM4 are at the L-level, the output of NOR1 becomes H-level. Due to this H-level signal, the output of OR2 also becomes H-level. By the output of OR2, the output of AND2 becomes H-level and further, the output of OR1 becomes H-level due to the output of AND2, emitting the light emitting diode LED1. Similarly, the light emitting diode LED2 also emits light. When the light receiving circuits 91 and 101 receives the light from the light emitting diodes LED1 and LED2, the switch circuits 3 and 4 are turned on, respectively.

The current detecting circuit 7 detects the current flowing in the luminescent lamp 5 through R101, rectifies the current for smoothing by the diode D101 and the condenser C101 and generates a voltage produced in the condenser C101 to the control circuit 11. In the same way, the current detecting circuit 8 generates a voltage produced in the condenser C201 to the control circuit 11.

When the secondary-side voltage of the transformer 24 rises up to the lighting voltage $V_5$ for the luminescent lamp 5 (at time t1), it is lighted to reduce the secondary-side voltage of the transformer 24. The lighting of the luminescent lamp 5 causes the flowing of a current in the lamp 5, so that the current also flows into R101 to cause a rise of the voltage of the condenser C101. When the voltage of the condenser 101 exceeds a reference voltage V101, the output of COM2 becomes H-level. This output is delayed by DELAY1 for a period td only and reversed to L-level by NOT1. Although the output of NOR1 is at the H-level because of no current flowing in either of the luminescent lamps at first, the output of NOR1 becomes L-level since the current flows in the luminescent lamp 5. As the output of OR2 is a logical sum of NOR1 and NOT1, the output of OR2 becomes L-level after the lapse of a period td since the flowing of current in the luminescent lamp 5 (at time t2). In the lighting mode, as the switching circuit 115 transmits the output of the lighting circuit 111 to LED1 as it is, then LED1 is turned off to produce no light from LED1. Thus, the switch circuit 3 is turned off.

When the switch circuit 3 is turned off, the luminescent lamp 5 is turned off to cause the secondary-side voltage of the transformer 24 to rise again. When the secondary-side voltage of the transformer 24 rises up to the lighting voltage $V_6$ for the luminescent lamp 6 (at time t3), it is lighted to reduce the secondary-side voltage of the transformer 24. The lighting of the luminescent lamp 6 causes the flowing of a current in the lamp 6, so that the current also flows into R201 to cause a rise of the voltage of the condenser C201. When the voltage of the condenser 201 exceeds a reference voltage V201, the output of COM4 becomes H-level.

When the switch circuit 3 is turned off at time t2, the voltage of C101 is lowered because of no current flowing in the luminescent lamp 5, so that the output of COM2 becomes L-level. Then, this output is delayed by DELAY1 for only a period td and further reversed to H-level by NOT1, causing an H-level output of OR2 (at time t4). The H-level signal is transmitted to the optical coupling circuit 9 to turn on the switch circuit 3. At this time, although the secondary-side voltage of the transformer 24 does not reach the lighting voltage $V_5$ for the luminescent lamp 5, the lighting can be accomplished at low voltage since the same lamp was lighted once.

At this point, both of the luminescent lamps 5 and 6 are brought into their lighted condition. That is, by the current flowing in the luminescent lamp 5, the voltage of C101 exceeds the reference voltage V101 so that the output of COM2 becomes H-level, while the output of NAND1 becomes L-level because of the H-level output of COM4 at time t3. The L-level output of NAND1 causes FF1 to be set to produce a H-level signal in the output Q and a L-level signal in the inverted output of Q. Thus, the outputs of AND2 and AND4 are together fixed in L-level, so that the outputs of the lighting circuits 111 and 112 are masked, while AND1 and AND3 transmit the outputs of the current regulating circuits 113 and 114, respectively. That is, the operation of the control circuit 11 is switched to the current regulating mode.

Note that the H-level output of COM4 at time t3 is delayed by DELAY2 for only the period td and further reversed to L-level by NOT2, so that the output of OR4 becomes L-level at time t5 after the lapse of the period td from time t3. However, it should be noted that, at the point of time t5, the operation of the control circuit has been already brought into the current regulating mode to mask the output of the lighting circuit 112. Therefore, there is no possibility that the switch circuit 4 is turned off at that time.

Figure 8:
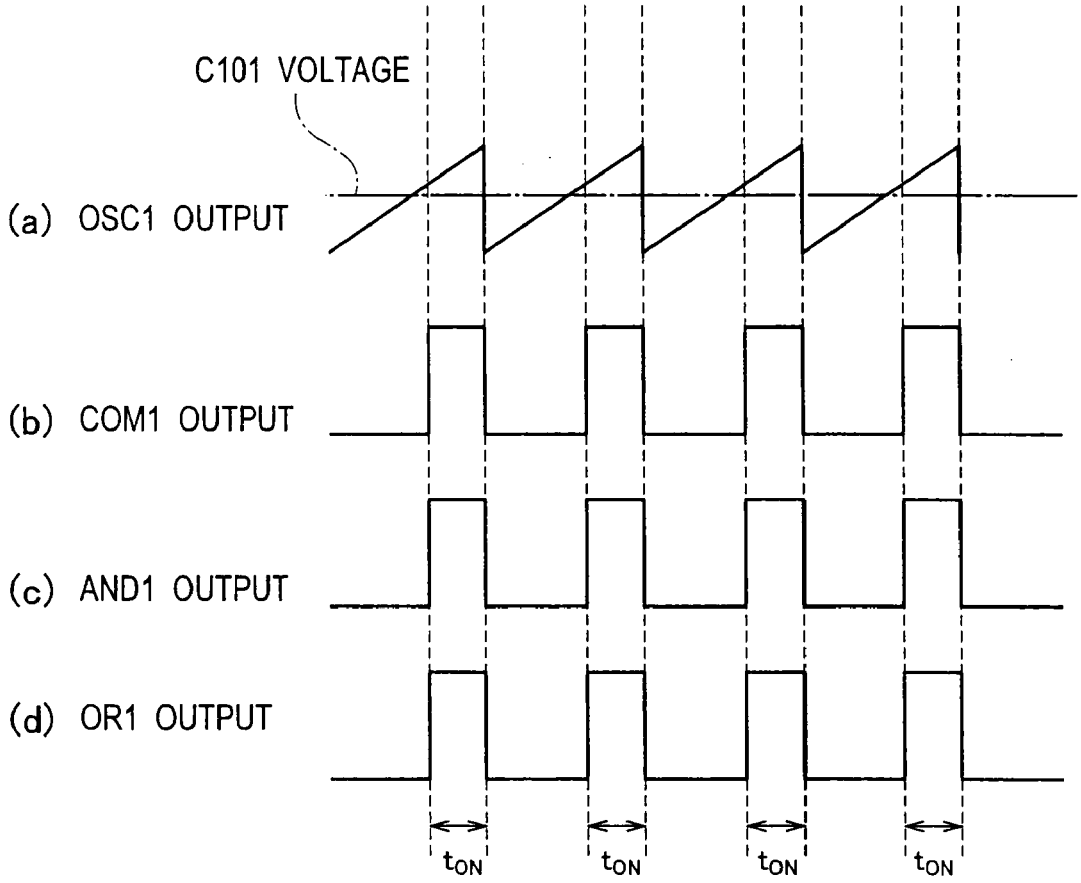
FIG. 8 is a time chart showing the operation of the control circuit of FIG. 6 in its current regulating mode.

Next, the operation of the so-constructed control circuit 11 of FIG. 6 in the current regulating mode will be described. FIG. 8 is a time chart showing the operation of the control circuit 11 of FIG. 6 in the current regulating mode. OSC1 is an oscillator for generating a pyramidal wave. This pyramidal wave is outputted to the non-inversion terminals of COM1 and COM3.

In the current regulating circuit 113, as shown in FIG. 8, the non-inversion terminal of COM1 inputs the pyramidal wave from OCS1, while the inversion terminal of COM1 inputs the voltage of C101. COM1 compares a voltage of the pyramidal wave with the voltage of C101 and outputs H-level pulses when the voltage of the pyramidal wave is larger than the voltage of C101.

That is, when the current flowing in the luminescent lamp 5 is large, a pulse width $t_{ON}$ becomes narrower. When the current flowing in the luminescent lamp 5 is small, the pulse width $t_{ON}$ becomes broader. The pulse is transmitted to AND1, OR1 and the optical coupling circuit 9, so that the ON/OFF cycle of the switch circuit 3 is adjusted. Therefore, the average of currents flowing in the luminescent lamp 5 is corrected and equalized. The current regulating circuit 114 operates in the same manner as the current regulating circuit 113.

It is noted that although the output of DELAY1 or DELAY2 in the current regulating mode is unstably changed by the pulse width of pulses turning on/off the luminescent lamp, there is no influence on the operation since the outputs of the lighting circuits 111 and 112 are masked by the switching circuit 115.

While FIG. 6 illustrates the circuit diagram in case of lighting two lamps, i.e. the luminescent lamps 5 and 6, the above operation could be accomplished in even a luminescent lamp device having three or more luminescent lamps. Then, upon increasing the numbers of lighting circuits and the number of current regulating circuits, it is performed to allow a lighted luminescent lamp to be turned off for a predetermined period and 5 and always switch the operation mode to the lighting mode or the current regulating mode after the whole luminescent lamps were turned on.

Thus, according to the luminescent lamp lighting device of this embodiment, the luminescent lamps 5 and 6 can be lighted without requiring a plurality of transformers certainly, with the above structure that: the switch circuits 3 and 4 are connected to the high-voltage sides of the luminescent lamps 5 and 6; the switch circuits 3 and 4 are turned on/off by the optical coupling circuits 9 and 10; the control circuit 11 controls the optical coupling circuits 9 and 10 based on the current values detected by the current detecting circuits 7 and 8; and the control circuit 11 controls the optical coupling circuits 9 and 10 so as to once turn on the luminescent lamps 5 and 6 but a luminescent lamp requiring a high lighting voltage in order of low lighting voltage, once turn off the so-lighted luminescent lamp and turn on the other luminescent lamp again after the luminescent lamp requiring the high lighting voltage has been lighted. Additionally, as there is no need of providing a ballast element in series with each luminescent lamp, it is possible to reduce the secondary-side voltage of the transformer in comparison with that of the conventional device.

Further, the switch circuits 3 and 4 are constructed so as to be activated since the photo diodes receive optical signals from LED and outputs them to drive FET. Therefore, as the circuits are electrically insulated except for the photodiodes and FET, there is less possibility that the circuits exert the influence on the high-frequency currents.

Generally, it is necessary to avoid an interposition of a component on the high-voltage side of the luminescent lamp as possible because the interposition may cause a leakage of current to reduce the current flowing in the luminescent lamp. While, according to the embodiment, as only the photodiode and FET are connected to the high-voltage side of the lamp, there is less influence on the current flow in the luminescent lamp, imposing no restriction on the positioning of the switch circuits 3 and 4 to be inserted.

Further, as the control circuit 11 controls the optical coupling circuits 9 and 10 to change the ON/OFF cycles of the switch circuits 7 and 8 in order that the averages of currents values detected by the current detecting circuits 7 and 8 are equalized to each other after turning on the luminescent lamps 5 and 6, the luminance of the luminescent lamps 5 and 6 is uniformed.

As obvious from the above descriptions, according to the present invention, a plurality of switch circuits are connected to a plurality of luminescent lamps under one-to-one correspondence, while the switch circuits are turned on/off by a plurality of optical coupling circuits under one-to-one correspondence. In the arrangement, the control circuit determines whether the luminescent lamps are lighting or not, based on the currents detected by a plurality of current detecting circuits connected to the luminescent lamps under one-to-one correspondence. Based on the determination result, the control circuit further controls the optical coupling circuits so as to allow all of the luminescent lamps but a luminescent lamp requiring a highest lighting voltage to be turned on in order of low lighting voltage, next allow the lighted luminescent lamps to be turned off, and allow all of the remaining luminescent lamps to be turned on again after turning on the luminescent lamp requiring the highest lighting voltage. Therefore, the plurality of luminescent lamps can be lighted without a plurality of transformers certainly. Additionally, there is no need of providing a ballast element in series with the luminescent lamp. Again, as the switch circuits are turned on/off by the optical coupling circuits, there is no restriction in the positioning of the switch circuited to be inserted in the luminescent lamps lighting device.

Furthermore, according to the present invention, the control circuit controls the optical coupling circuits to control respective cycles of turning on/off the switch circuits so that an average of currents, which are detected by the plurality of current detecting circuits after all the luminescent lamps are turned on, becomes a predetermined value, respective luminance of the luminescent lamps is equalized to each other.

INDUSTRIAL APPLICABILITY

The present invention is applicable to a luminescent lamp lighting device for lighting luminescent lamps, such as cold cathode fluorescent lamps.

The invention claimed is:

1. A luminescent lamp lighting device comprising:

an inverter converting direct-current voltage to high-frequency voltage;

a plurality of luminescent lamps to which the high-frequency voltage generated from the inverter is applied, the luminescent lamps being connected in parallel to each other;

a plurality of switch circuits each connected to each of the luminescent lamps in series under one-to-one correspondence;

a plurality of optical coupling circuits each connected to each of the switch circuits under one-to-one correspondence to turn on/off the switch circuits;

a plurality of current detecting circuits each connected to each of the luminescent lamps in series under one-to-one correspondence to detect respective currents flowing the luminescent lamps; and a control circuit configured to determine whether the plurality of luminescent lamps are lighting or not, based on the currents detected by the plurality of current detecting circuits and control the optical coupling circuits based on the determination result so as to:

allow all of the luminescent lamps but a luminescent lamp requiring a highest lighting voltage to be turned on in order of low lighting voltage;

next allow the lighted luminescent lamps to be turned off; and allow all of the remaining luminescent lamps to be turned on again after turning on the luminescent lamp requiring the highest lighting voltage.

2. The luminescent lamp lighting device of claim 1, wherein the control circuit controls the optical coupling circuits to control respective cycles of turning on/off the switch circuits so that an average of currents, which are detected by the plurality of current detecting circuits after all the luminescent lamps are turned on, becomes a predetermined value.

* * * * *